US009149712B2

(12) United States Patent
Hering et al.

(10) Patent No.: US 9,149,712 B2
(45) Date of Patent: Oct. 6, 2015

(54) ROLLER SKATE AND ASSEMBLING STAND

(71) Applicants: Miloslav Hering, Plzen (CZ); Pavel Martinek, Plzen (CZ)

(72) Inventors: Miloslav Hering, Plzen (CZ); Pavel Martinek, Plzen (CZ)

( * ) Notice: Subject to any disclaimer, the term of this patent is extended or adjusted under 35 U.S.C. 154(b) by 162 days.

(21) Appl. No.: 13/922,131

(22) Filed: Jun. 19, 2013

(65) Prior Publication Data

US 2014/0034796 A1 Feb. 6, 2014

(30) Foreign Application Priority Data

Jun. 20, 2012 (CZ) ..... 2012-416

(51) Int. Cl.

| | |
|---|---|
| ***A63C 17/00*** | (2006.01) |
| ***A63C 17/06*** | (2006.01) |
| ***A63C 17/14*** | (2006.01) |
| ***A63C 17/22*** | (2006.01) |

(52) U.S. Cl.

CPC ..... *A63C 17/00* (2013.01); *A63C 17/0006* (2013.01); *A63C 17/0046* (2013.01); *A63C 17/06* (2013.01); *A63C 17/1418* (2013.01); *A63C 17/1427* (2013.01); *A63C 17/22* (2013.01); *A63C 2017/1472* (2013.01); *A63C 2203/44* (2013.01)

(58) Field of Classification Search

CPC ..... A63C 17/0006; A63C 17/0046; A63C 17/06; A63C 17/1418; A63C 17/00; A63C 17/22; A63C 17/1427; A63C 2017/1472; A63C 2203/44

USPC ..... 248/231.71; 280/11.215, 11.221, 280/11.223, 11.224, 11.225, 11.231

See application file for complete search history.

(56) References Cited

U.S. PATENT DOCUMENTS

| | | | | |
|---|---|---|---|---|
| 1,050,490 | A * | 1/1913 | Schwarz | 280/11.215 |
| 2,557,331 | A * | 6/1951 | Wintercorn | 280/11.28 |
| 4,277,006 | A | 7/1981 | Pinckard | |
| 5,029,882 | A * | 7/1991 | Marandel | 280/11.209 |

(Continued)

FOREIGN PATENT DOCUMENTS

| | | |
|---|---|---|
| CN | 2326302 | 6/1999 |
| DE | 9419948 U1 | 2/1995 |

(Continued)

OTHER PUBLICATIONS

Search Report from Corresponding European Application No. EP13003096 mailed Sep. 26, 2013 (3 pages).

(Continued)

*Primary Examiner* — Brodie Follman
*Assistant Examiner* — Brian Cassidy
(74) *Attorney, Agent, or Firm* — Hovey Williams LLP

(57) ABSTRACT

A roller skate is equipped with three or four wheels arranged in one line on the carrier which is joined to the shoe. Each wheel is cushioned independently with a spring system including at least two compression springs. A front wheel can be provided with two springs the longitudinal axes of which are oriented in the extent between the horizontal and vertical directions with the bottom ends of the springs being placed in front of the top ends of the springs or under them. Other wheels may be equipped with four springs having the longitudinal axes of the spring oriented vertically. At least two wheels can be provided with a braking system including clips with brake pads on both sides. The roller skate may be used and maintained on a specially configured assembling stand.

6 Claims, 12 Drawing Sheets

(56) References Cited

U.S. PATENT DOCUMENTS

| | | | | | |
|---|---|---|---|---|---|
| 5,114,166 | A * | 5/1992 | McCosker | 280/87.042 |
| 5,398,949 | A * | 3/1995 | Tarng | 280/11.206 |
| 5,632,329 | A | 5/1997 | Fay | |
| 5,704,621 | A | 1/1998 | Lazarevich | |
| 5,709,396 | A * | 1/1998 | Zorzi et al. | 280/11.28 |
| 5,918,889 | A * | 7/1999 | Tai | 280/11.225 |
| 6,086,072 | A * | 7/2000 | Prus | 280/11.28 |
| 6,193,249 | B1 * | 2/2001 | Buscaglia | 280/87.042 |
| 6,416,063 | B1 * | 7/2002 | Stillinger et al. | 280/11.223 |
| 6,454,280 | B1 * | 9/2002 | Longino | 280/11.28 |
| 6,478,312 | B1 * | 11/2002 | Petrucci et al. | 280/11.211 |
| 6,644,673 | B2 * | 11/2003 | Longino | 280/11.28 |
| 6,863,283 | B1 * | 3/2005 | Houston et al. | 280/11.225 |
| 7,341,262 | B2 * | 3/2008 | Liu | 280/11.28 |
| 2002/0030332 | A1 | 3/2002 | Longino | |
| 2003/0075886 | A1 * | 4/2003 | Smeden et al. | 280/11.225 |

FOREIGN PATENT DOCUMENTS

| | | | |
|---|---|---|---|
| DE | 29702396 | U1 | 6/1997 |
| DE | 20004929 | U1 | 5/2000 |
| DE | 10140564 | A1 | 4/2003 |
| DE | 10159913 | A1 | 4/2003 |
| DE | 202006016778 | U1 | 2/2007 |
| DE | 202006019751 | U1 | 4/2007 |
| EP | 0608576 | A1 | 8/1994 |
| FR | 2816516 | A1 | 5/2002 |
| WO | 01/03783 | A1 | 1/2001 |
| WO | 2007/057523 | A1 | 5/2007 |
| WO | 2008/082675 | A1 | 7/2008 |

OTHER PUBLICATIONS

Search Report from Corresponding Czech Application No. PV 2012-416, completed Mar. 15, 2013 (1 pages).

* cited by examiner

ROLLER SKATE AND ASSEMBLING STAND

BACKGROUND OF THE INVENTION

1. Field of the Invention

The invention relates to roller skates, and more particularly to roller skates which are specifically adapted to be capable of riding on public roads. Thanks to their structural shape they can be used on low-quality surfaces and in a hilly terrain.

2. Description of the Related Art

According to the hitherto state of engineering there are many kinds of roller skates. This includes roller skates, as opposed to roller skis, which are designed to permit the user to ride on lower-quality surfaces owing to the structure thereof. In these known roller skates, one inflatable wheel is provided in front of the shoe and another behind it. Owing to technological problems in producing inflatable tire wheels having sufficient loading capacity, the wheels have a relatively large diameter (140 mm at least) and therefore do not fit under the shoe. However, such a roller skate is very long and relatively heavy. Therefore, the skating differs slightly from that experienced on classic roller skates and resembles rather the ride on the above-mentioned roller ski.

A roller skate according to the Czech Republic patent document CZ 12229 U1 is equipped with a braking system. However, there is a known disadvantage of this braking system in that when using it, the tire sidewalls are damaged. In addition to shorter service life of this system, this fact influences negatively the braking power as well.

Until this time, assembling stands are not in use for roller skates. This is especially because the known roller skates are simple and typically need not be assembled or adjusted.

BRIEF SUMMARY OF THE INVENTION

The substance of the present invention is to construct a roller skate and an assembling stand especially configured for roller skates. The roller skate may be equipped with three or four wheels arranged in one line on a carrier which is joined to a shoe.

The under-carriage of the three-wheel version of the roller-skate may be provided two size-variants the first one of which may cover, for example, U.S. men's shoe sizes of nos. 4 to 9 and the second size-variant covers the corresponding shoe sizes over no. 9. The under-carriage of the four-wheel roller-skate version may include a one size-variant advantageously which may cover, for example the shoe sizes corresponding to U.S. men's size no. 7 and greater. The size-variants may be especially reflected by design parameters including the stiffness of the springs and the wheel diameter.

Each wheel may be spring-loaded independently with a spring system preferably including at least two coiled compression springs. For example, in a three-wheel version the skate may be equipped with 10 springs located in bushings. In such case, the force exerted by each spring may be in the range of 7 to 15 kg at maximum depression which force may vary according to the rider's weight and the shoe size. Also by way of example, in a four-wheel version the skate may be provided with 14 springs located in bushings. In this example, at a maximum depression, the force exerted by each spring may be in the range of 7 to 15 kg, again varying according to the rider's weight and shoe size. Owing to the spring-loading structure according to this scheme, satisfactory loading capacity and good functionality thereof is achieved.

In a preferred embodiment, the front wheel may be equipped with two springs, the longitudinal axes of which may be oriented between horizontal and vertical directions.

The bottom ends of the springs may be placed in a space in front of the top ends of the springs or below them. In other words, the springs are oriented so as to resist the front wheel from being drawn negatively. The other wheels may be furnished with four springs with the spring longitudinal axes being oriented substantially upright or vertically. The beneficial result of this scheme regarding the orientation of the front-wheel spring may be the provision of better riding properties of skates in passing over small unevenness and also to provide certain rebound energy in skating.

In a further solution provided by the invention hereof, the skate may be braked. In such case at least two wheels may be equipped with brakes on both sides, these brakes being fastened to the carrier with, for example, a hinge joint or a pivot connection, respectively. The brakes may be of regarded as linear or direct-pull brakes. The brake can be controlled with a rope or other flexible elongated member such as a Bowden cable joined to a manual controller. In preferred embodiments, each braked wheel may have a brake clip which is equipped with a brake block or pad located at or proximate to the wheel disk or at or proximate to the wheel tire sidewall. With this, the secure control of the skates is provided especially in hilly terrain, even for less experienced users. The advantage of this solution includes the provision of individual braking of each skate or each foot respectively which is useful especially in riding uphill. The foot the rider takes off with can be braked partially and so the rider can take off in a steep hill more effectively.

In another variant solution the skate may be provided with wheels with inflatable tubeless tires. In such case, either an air duct may be included in the wheel disk in which a valve insert may be installed such as by screwing into a threaded receptacle, or alternatively the valve may be implanted in the tire casing directly. The valve insert may be provided of the types known and usually found as a valve of an automobile, a motorcycle or a bicycle (for example, valves of the type known to those skilled in the art as Schrader valves, Dunlop valves or Presta valves are some of the types of valves which may be used). Advantageously, this solution is simple and unpretentious financially in comparison with the solutions utilizing special valves.

In another advantageous solution the inflatable tubeless tires may have a bead made of rubber and/or of the rubber-textile combination. In such case the tire bead may have a groove into which a duct lug fits and further the tire bead may include a boss which fits into the groove of the disk. Such an arrangement provides a lock system, including lugs and grooves, which provides reliable and air-proof fastening of the tire on the disk without need to use expensive wire skeletons with the tire.

In case the brake block or pad is located at or proximate the place of the sidewall of the tire mounted on a wheel disc, the sidewall may be equipped with a metal ring-shaped surface for contacting the brake block or pad. This metal contacting surface protects the tire from damage owing to friction generated in braking.

According to the described invention, a spring-cushioned roller skate of reliable structure is achieved. Such skate provides considerable skating comfort on even moderately uneven surfaces. Due to the invention hereof, the manoeuvrability and security characteristics of the skate are improved while at the same time the skate according to the present invention limits the danger of a fall in riding on uneven surfaces, e.g. on a pebbled surface. The riding properties are very good in comparison to hitherto known roller skates, especially in embodiments when the improved skates hereof use coiled compression spring cushioning and inflatable (i.e. pneumatic) tires.

For assembly or work on a roller skate, especially that according to the presented invention, the proposed assembling stand can be used. The assembling stand includes a main girder, and may be equipped with screwed clamp for fastening to a desk, especially that of a work desk. The main girder, or the whole assembling stand respectively, may be oriented mainly so that the screwed clamp is on the bottom end of the main girder. On a second end, typically the top end, the main girder may be provided with a girder shifting and rotary joint. An auxiliary girder may be attached to the girder joint. The end of the auxiliary girder may be equipped with a longitudinally adjustable pull-out arm. The length of the pull-out arm can be set according to the shoe size of the roller skate.

The roller skate can be put on the pull-out arm and so fastened to the assembling stand in the same way as to the rider's foot. Thanks to the girder shifting and rotary joint, the fastened roller skate can be rotated and tilted arbitrarily according to needs of the skate assembling or cleaning, etc.

BRIEF DESCRIPTION OF THE DRAWINGS

The exemplary embodiment of the proposed solution is described with reference to drawings wherein.

DETAILED DESCRIPTION OF THE INVENTION

Example No. 1

Figure 1:
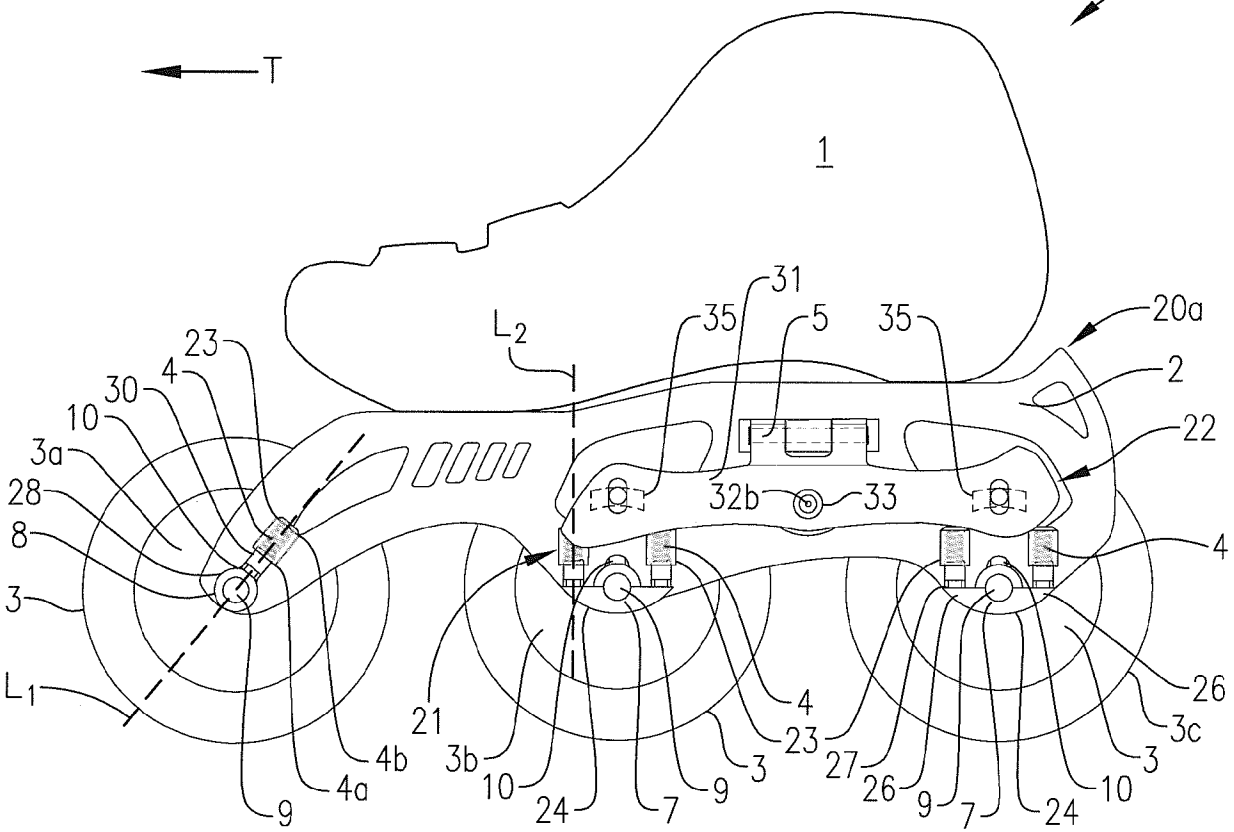
FIG. 1 is a left side elevational view of a skate showing a three-wheel configuration with a brake.
Figure 2:
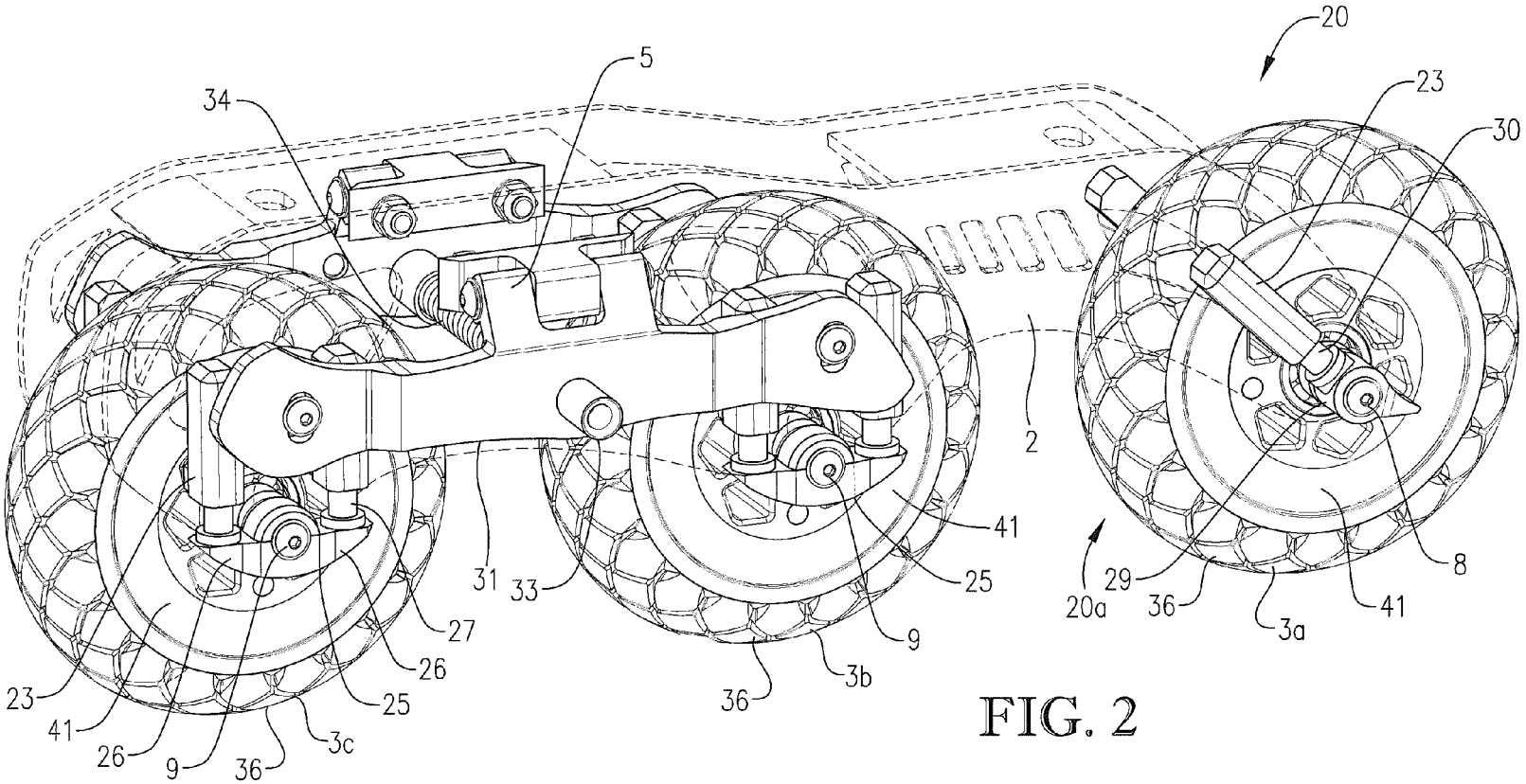
FIG. 2 is an enlarged fragmentary right rear isometric view of the skate of FIG. 1, showing a carrier of the skate in phantom and the wheels, suspension system, and braking system in greater detail.

The roller skates 20 according to the present invention include a first embodiment of the roller skate 20*a* which may be equipped with three wheels 3, which are respectively identified in FIG. 1 as front wheel 3*a*, center wheel 3*b*, and rear wheel 3*c*. The wheels 3*a*, 3*b* and 3*c* may be arranged in one line on a carrier 2 which is joined, for example by mechanical fasteners, adhesive, bonding or the like to a shoe 1. By way of example only, the diameter of the wheels 3 may be 105 mm. Each wheel 3 is independently cushioned with a spring suspension system 21 which may include two or more compressible coiled springs 4 as shown in FIGS. 1 and 2. The roller skates 20 as shown may be equipped with 10 such springs 4. With maximum depression (i.e., when the springs are compressed by a skater), the force exerted by each spring 4 may be in the range of 7 to 15 kg which may vary according with the rider's weight and size of his/her shoes.

The front wheel 3*a* may be provided with two springs 4, the springs 4 associated with the front wheel having longitudinal axes $L_1$ which are preferably oriented on an incline between (but preferably not including) horizontal and vertical directions with the bottom ends 4*a* of the springs 4 being located in front of the top ends 4*b* of the springs 4 relative to the ordinary forward direction of travel T and/or under the top ends 4*b*. The longitudinal axis $L_1$ of the springs 4 of the front wheel 3*a* is most preferably about 45° with respect to the vertical. Other wheels 3 may be equipped with four springs 4 having substantially vertically oriented longitudinal axes $L_2$ of the springs 4 when the skate 20 is in a normal, upright position as shown in FIG. 1. The springs 4 act as a suspension and connect wheel bearings 7 of center wheel 3*b* and rear wheel 3*c* to the carrier 2, and connect wheel bearings 8 of front wheel 3*a* to the carrier 2. Each of the wheels 3 is provided with an axle 9 about which the respective wheel 3 rotates, and the axle 9 is then received by the respective wheel bearings 7 or 8. The carrier 2 is provided with slots 10 which permits the axles 9 (and the respective one of the wheels 3 carried thereby) to move generally upwardly and downwardly relative to the carrier 2 (the front wheel 3*a* also moving rearwardly and forwardly according to the angle of the longitudinal axis $L_1$ of the associated springs), this movement being permitted by the compression of the springs 4 which, when the external force acting on the respective wheel 3 is removed, causes each wheel 3, which is independently suspended, to move downwardly with respect to the orientation of the skate 20 shown in FIG. 1, and return to the initial position shown in FIG. 1. The top or upper end of the slot 10 also acts as the top stop of each wheel when moving upwards—that is, the slot defines and limits both the upward and downward range of travel of the respective axles 9 and the wheels 3 carried thereon. It is to be understood that while FIG. 1 illustrates only one side elevational view of the skate 20, it is to be understood that two of the springs 4 are positioned on each side of the carrier 2 for each of the center wheel 3*b* and rear wheel 3*c*, and one spring 4 located on each side of the carrier 2 for the front wheel 3*a*, such that the total number of springs for the skate 20 as shown in FIG. 1 is 10.

Figure 3:
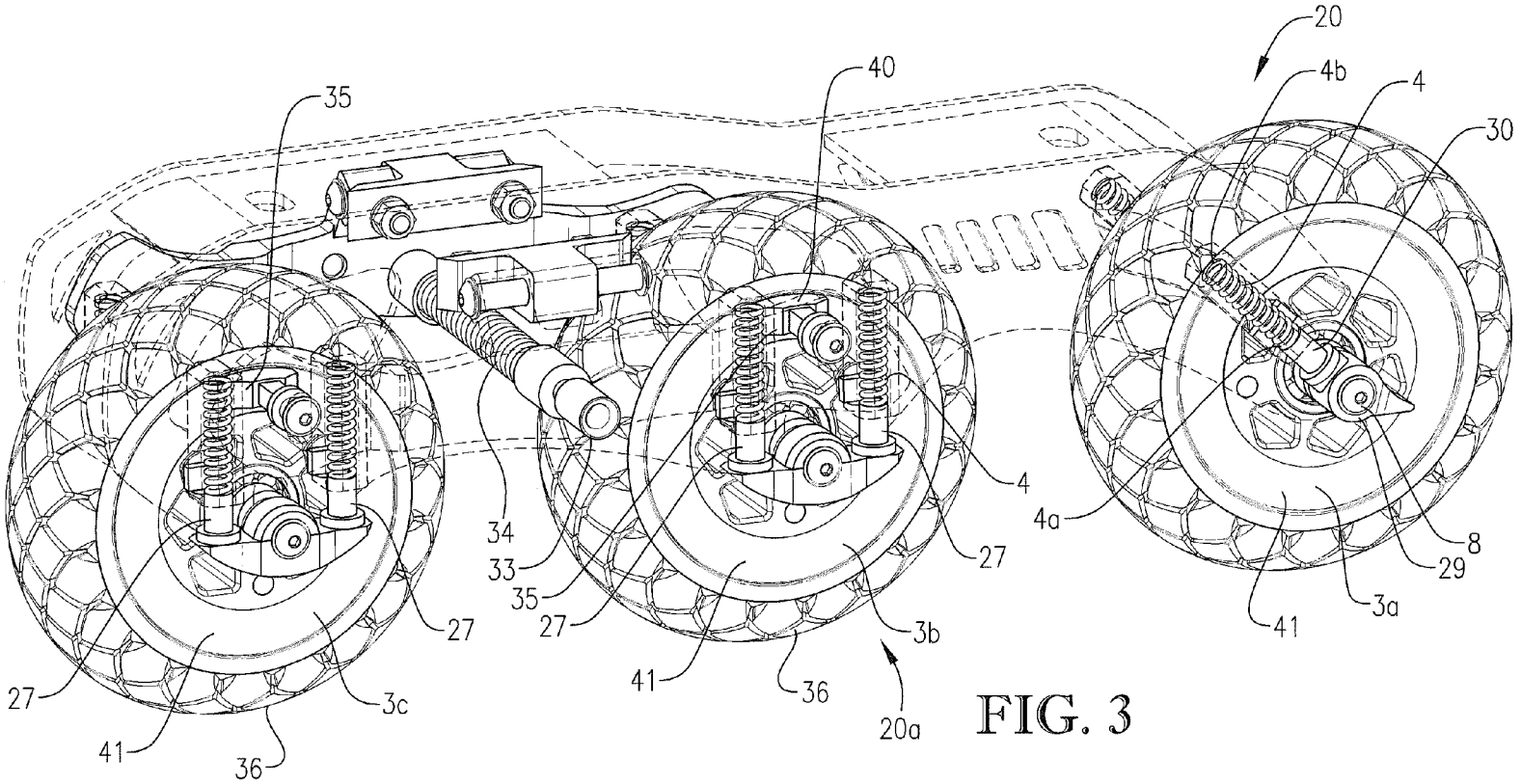
FIG. 3 is an enlarged fragmentary right rear isometric view similar to FIG. 2, but wherein jackets surrounding coiled springs of the suspension system and the clips of the braking system are shown in phantom lines for clarity.
Figure 4:
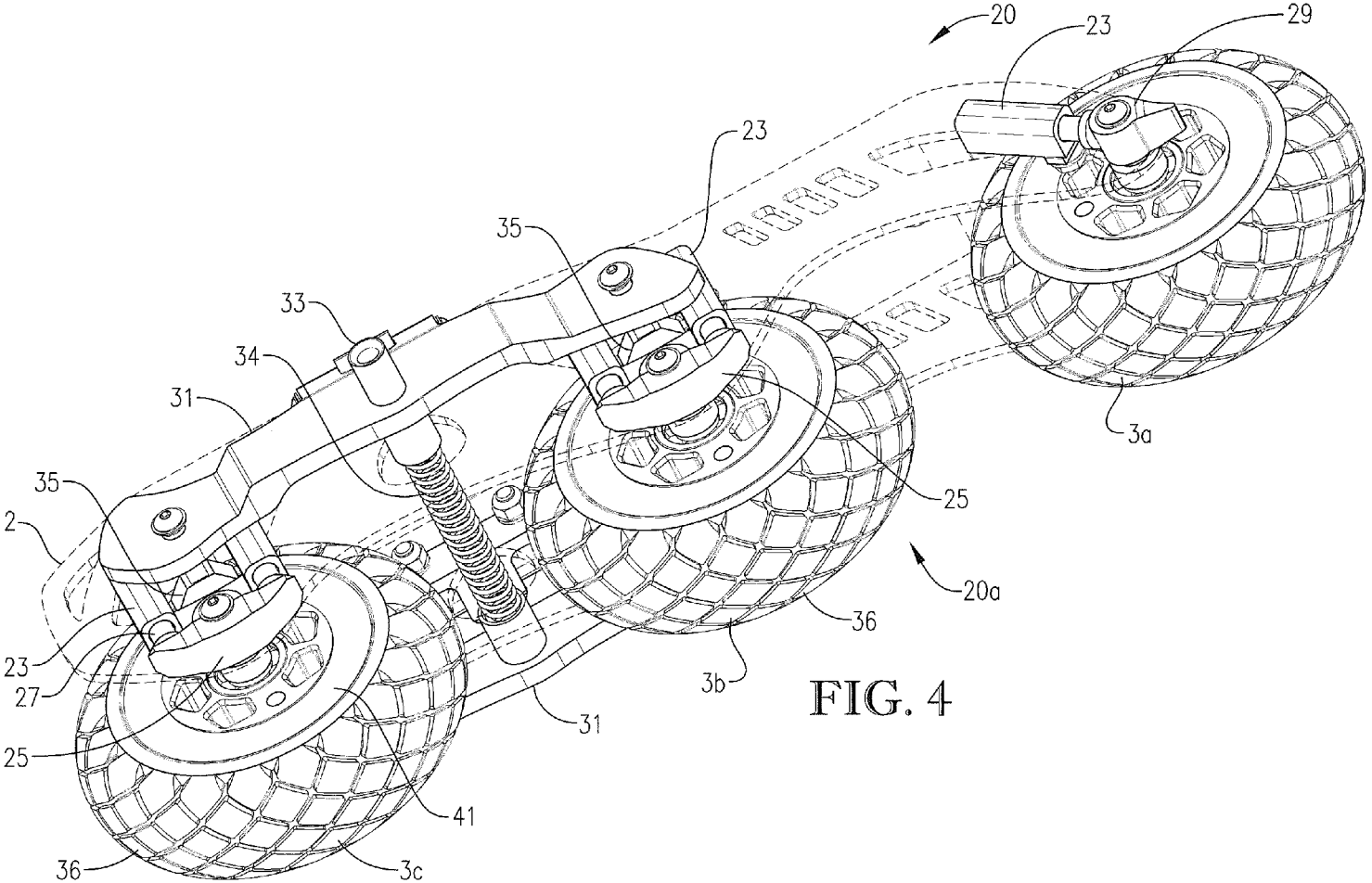
FIG. 4 is an enlarged fragmentary bottom right isometric view of similar to FIG. 1, showing the carrier in phantom lines and detailing the brake pads attached to the clips and a spring biasing the clips carrying the brake pads to an unbraked position.

FIGS. 2, 3 and 4 omit the shoe 1 and show the carrier 2 in phantom lines in order to show the suspension system 21 and a skate braking system 22 more clearly. FIGS. 2-9 and 11 show the carrier 2 in greater detail. As may be seen in particular in FIGS. 5 and 11, the carrier 2 may include parallel, fore- and aft oriented, spaced-apart left and right carrier frames 2*a* and 2*b* which receive wheels 3 therebetween. The carrier frames 2*a* and 2*b* may be connected by carrier bridges 2*c* and 2*d* which may be attached to each of the carrier frames 2*a* and 2*b* to connect them in spaced-apart relationship. The carrier brides 2*c* and 2*d* may be provided with holes 2*e* which permit mechanical fasteners or the like to pass therethrough and mount the shoe 1 to the carrier 2. In addition to slots 10 which permit limited shiftable movement of the axles 8 and 9 therein, the carrier frames 2*a* and 2*b* may include openings 2*f* located proximate the axles 9 which permit brake pads 35 to pass therethrough and apply a braking force to the wheels 3, and passages 2*g* which permit a rope or other flexible member such as an inner cable of a Bowden cable 32 to pass therethrough.

Figure 5:
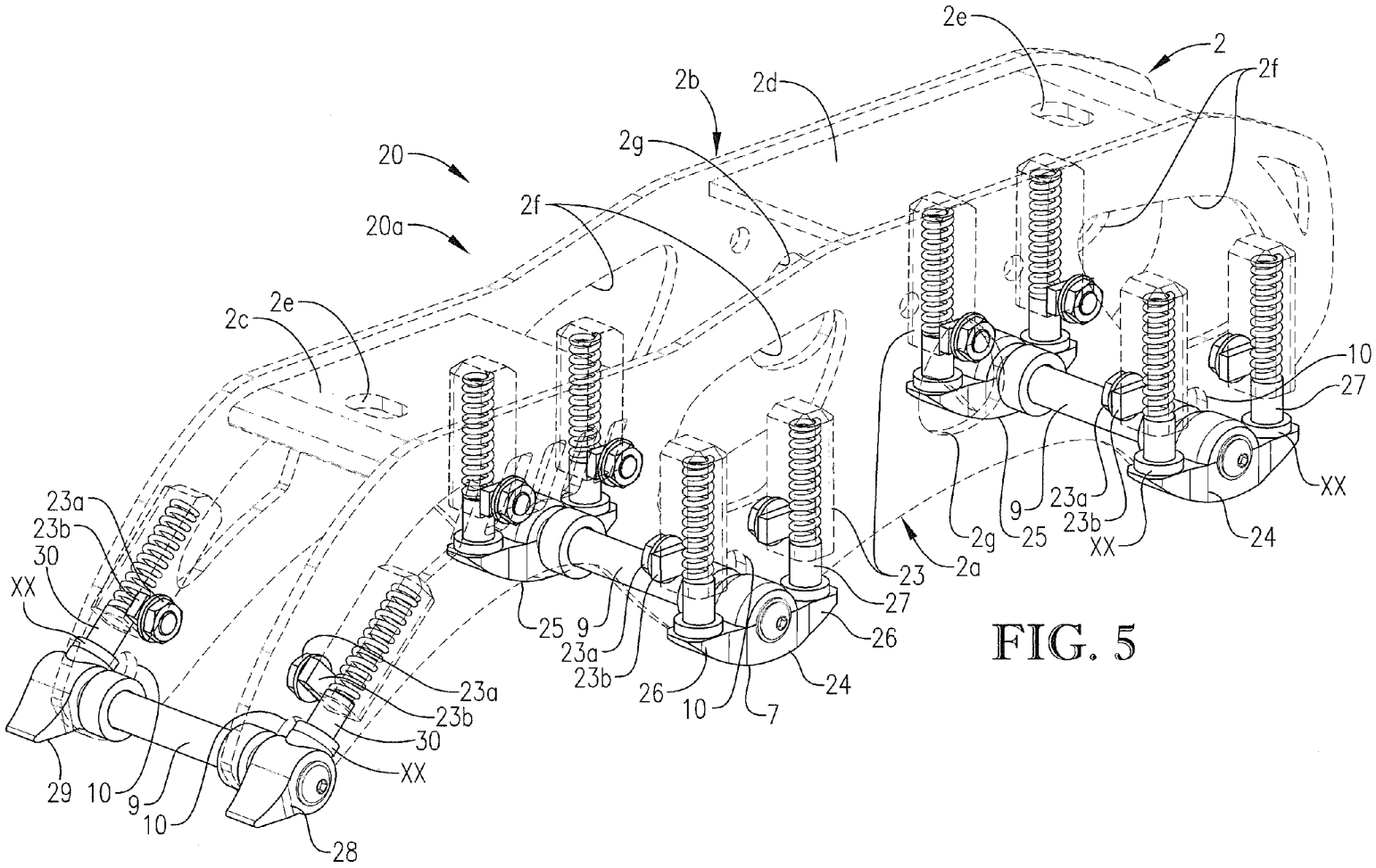
FIG. 5 is an enlarged fragmentary top front left isometric view of the suspension system of the skate hereof with the shoe and wheels removed and the carrier and bushings shown in phantom lines to show the hubs, axles and springs and the attachment of the bushings to the carrier.
Figure 11:
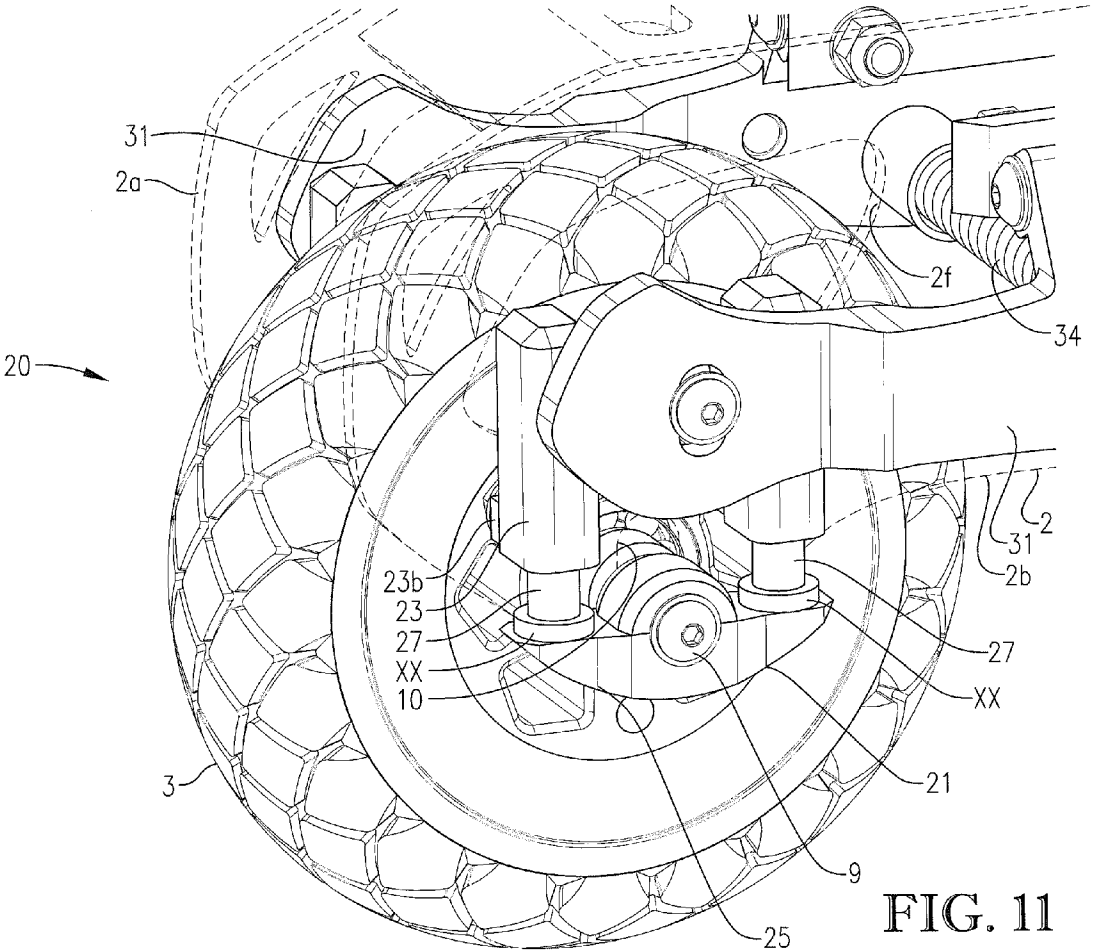
FIG. 11 is an enlarged, fragmentary isometric view showing the bushings and stubs of a rearmost, braked wheel to show resilient rings positioned around the stubs and between the ears of the hubs and the bushings.

The suspension system 21 may include the aforementioned springs 4 which are enclosed within bushings 23 mounted on the carrier 2 by fasteners, for example nut and bolt threaded fasteners 23*a* passing through holes in mounts 23*b* of the bushings 23 as shown in FIGS. 5 and 11. The bushings 23 serve to both hold the springs 4 against escape and provide an enclosure which causes the springs 4 to compress and absorb load forces applied thereto during upward movement of the wheels 3. The bushings 23 also help to limit the amount of upward travel of the bearings 7 and 8, as before reaching maximum compression of the springs 4, a resilient ring XX of, for example, natural or synthetic rubber, which resilient ring XX may be positioned on a stub 27 or 30 of the bearings 7 or 8 respectively, contacts the lower margin of the bushings 23. When the springs 4 are compressed heavily, the resilient ring XX acts as a first soft stop while the top end of the slot 10 acts as a final hard stop of the compression of the springs 4. The final hard stop is reached before maximum compression of the springs 4 which prevents springs 4 from being damaged by a compression beyond the projected movement of the axles 9 and the design limits of the springs 4. In providing a first soft stop, the rings XX are thus squeezed between the bearings 7 or 8 and the lower margin of the bushings 23. The bearings 7 may include a first hub 24 and a second hub 25 positioned on the outboard left and right sides of the carrier 2 respectively, each of the hubs 24 and 25 receiving the axle 9 therethrough, and each of the hubs 24 and 25 may have a pair of oppositely extending ears 26, one of the ears 26 extending forwardly and the other rearwardly of the axle 9. Each of the ears 26 may include an upwardly extending stub 27 on which the springs 4 may be mounted, the stubs 27 most preferably being sized and positioned to receive the springs 4 thereon and to fit interiorly of a respective one of the bushings 23 when force is applied to the wheel 3 to compress the spring 4. The axle 9 may either be affixed to the wheel 3 and rotate within the hubs 24 and 25 of a respective one of the bearings 7, or the hubs 24 and 25 of the bearings 7 may be fixed to the axle 9 and the wheels 3 rotate about the axle 9. The bearings 8 may also be provided with both a first hub 28 and a second hub 29 positioned on respective sides of the carrier. Each of the hubs 28 and 29 may receive the axle 9 of the front wheel 3*a* and also may be provided with a pair of stubs 30 for mounting springs 4 thereon, the stubs 30 fitting within the bushings 23 when force is applied to the wheel 3*a* to compress the spring 4. Rings XX are also mounted on the stubs 30 to cushion downward and forward movement of the bushing 23 during suspension travel.

Figure 7:
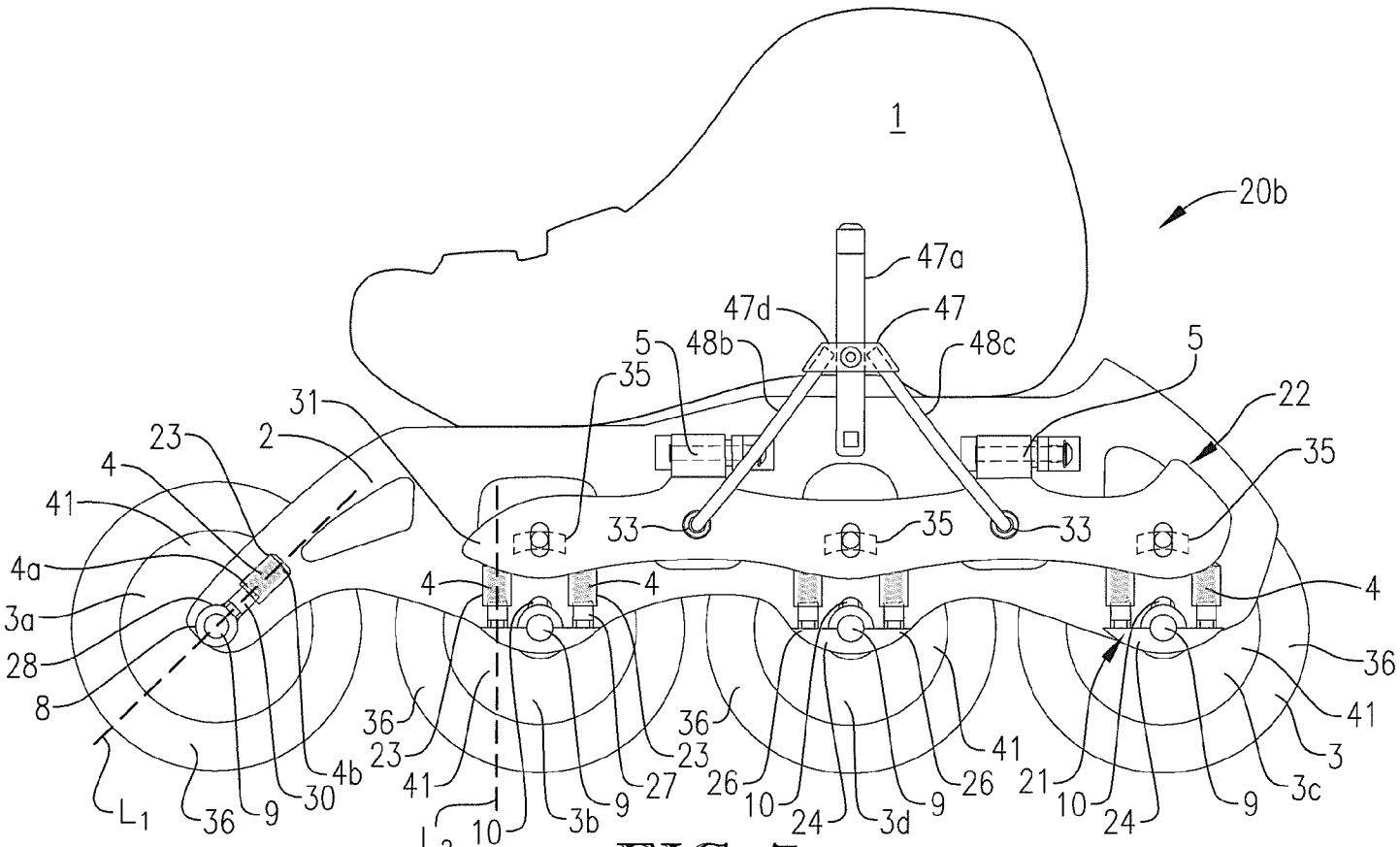
FIG. 7 is a left side elevational view of skate similar to that shown in FIG. 1 but wherein the skate is of a four-wheel configuration with a brake.
Figure 8:
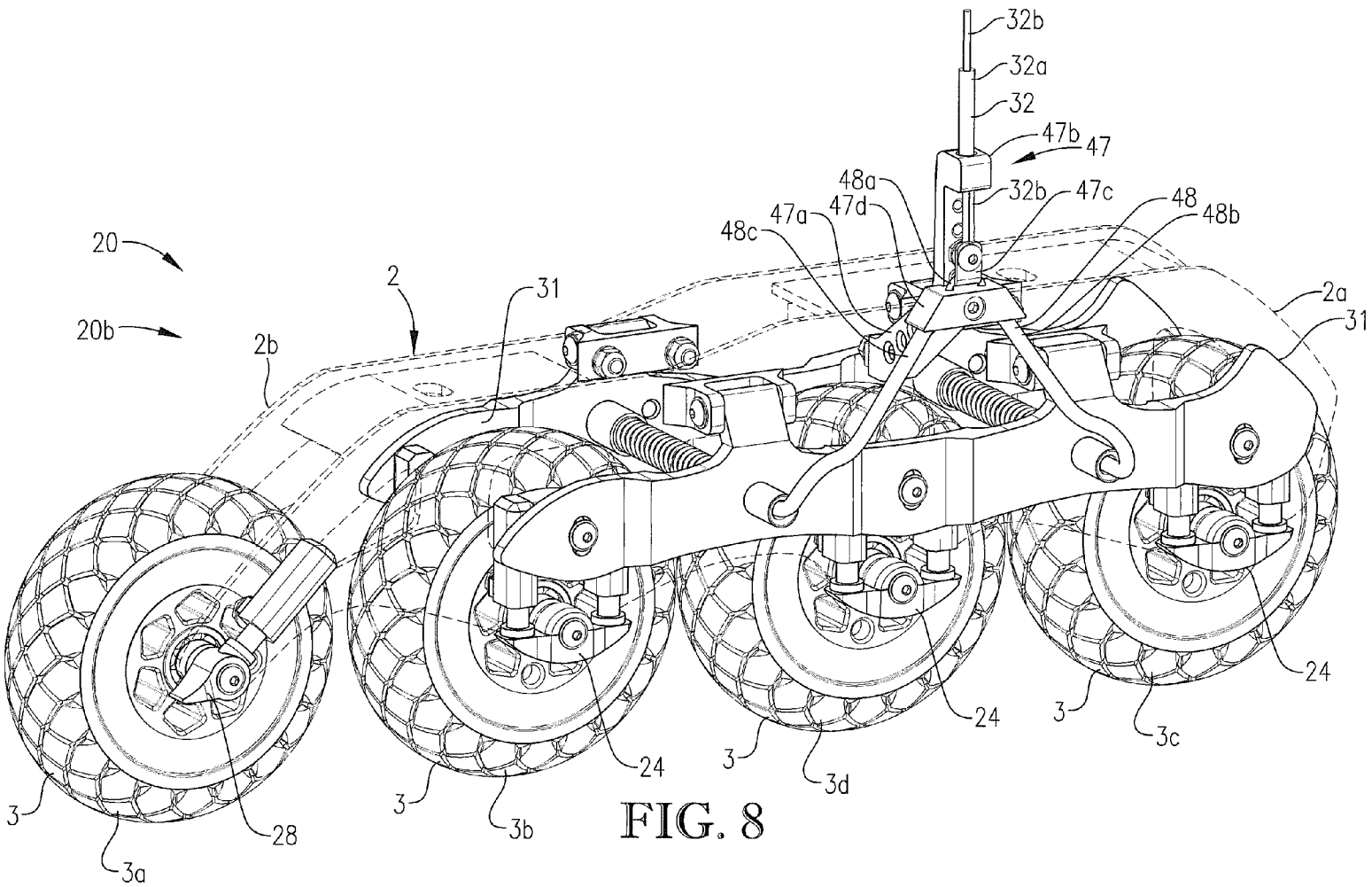
FIG. 8 is a fragmentary top left front isometric view of the roller skate hereof in the four-wheel configuration with a brake, wherein the shoe is removed for clarity and the carrier is shown in phantom lines for clarity, the braking system including a yoke and secondary Bowden cable arrangement for equalizing braking force on the clips of the braking system.
Figure 9:
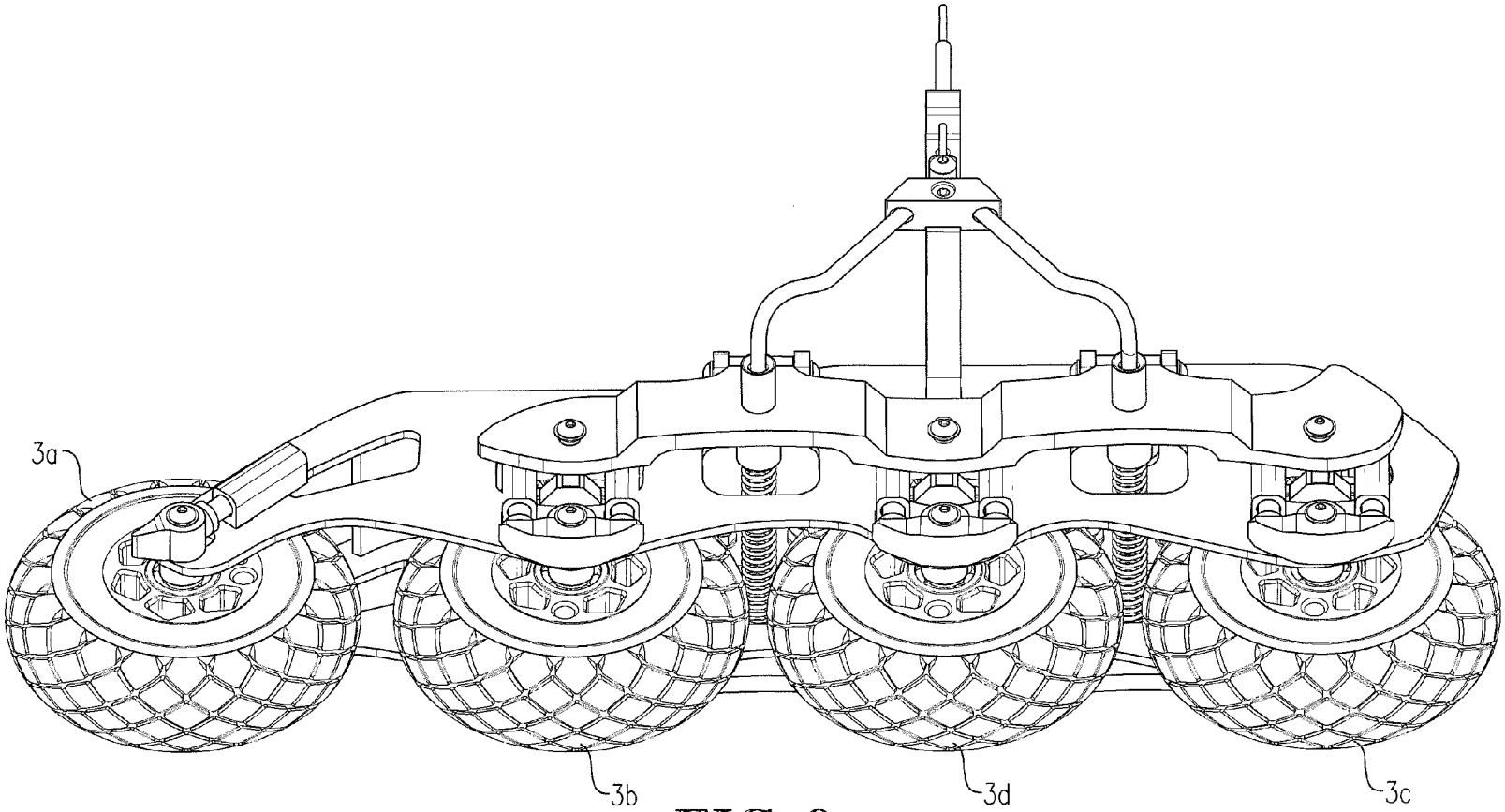
FIG. 9 is a fragmentary bottom left isometric view of the roller skate hereof in the four-wheel configuration showing the brake pads positioned adjacent the rear, braked wheels and the yoke with the secondary Bowden cable.

The roller skate 20 of the present invention may also include a second embodiment of the roller skate 20*b* as shown in FIGS. 7-9, which roller skate 20*b* may have the same general configuration as the roller skate 20*a* shown in FIGS. 1-5, and wherein like numbers are used to show the same components. In the roller skate 20*b*, the wheels 3 may be provided in an in-line configuration as in roller skate 20*a*, with a carrier 2 attached to shoe 1, for example by mechanical fasteners, adhesives, bonding or by similar means. The carrier of roller skate 20*b* is configured to be supported on four wheels, having a front wheel 3*a*, a rear wheel 3*c*, and intermediate center wheels 3*b* and 3*d*. Similar to skate 20*a* of FIG. 1, each of the wheels 3*b*, 3*c* and 3*d* are provided with first and second hubs each mounting two springs 4 on each side of the carrier 2 on stubs 30, the springs 4 connecting the respective bearing 8 to the carrier 2 for shiftable up and down movement which is beneficial to stability as the skate 20*b* moves along uneven surfaces. As with skate 20*a* of FIG. 1, the front wheel 3*a* of skate 20*b* is cushioned by two springs 4, one on each side of the carrier, to permit the axle 9 to shift along the respective slot 10 in the carrier 2 according to the longitudinal axis $L_1$ of the spring 4 and the wheel 3*a* on which the carrier 2 is supported. Thus, for skate 20*b*, a total of 14 springs 4 are provided (four springs 4 for each of wheels 3*b*, 3*c* and 3*d*, and two springs 4 for wheel 3*a*).

Figure 6:
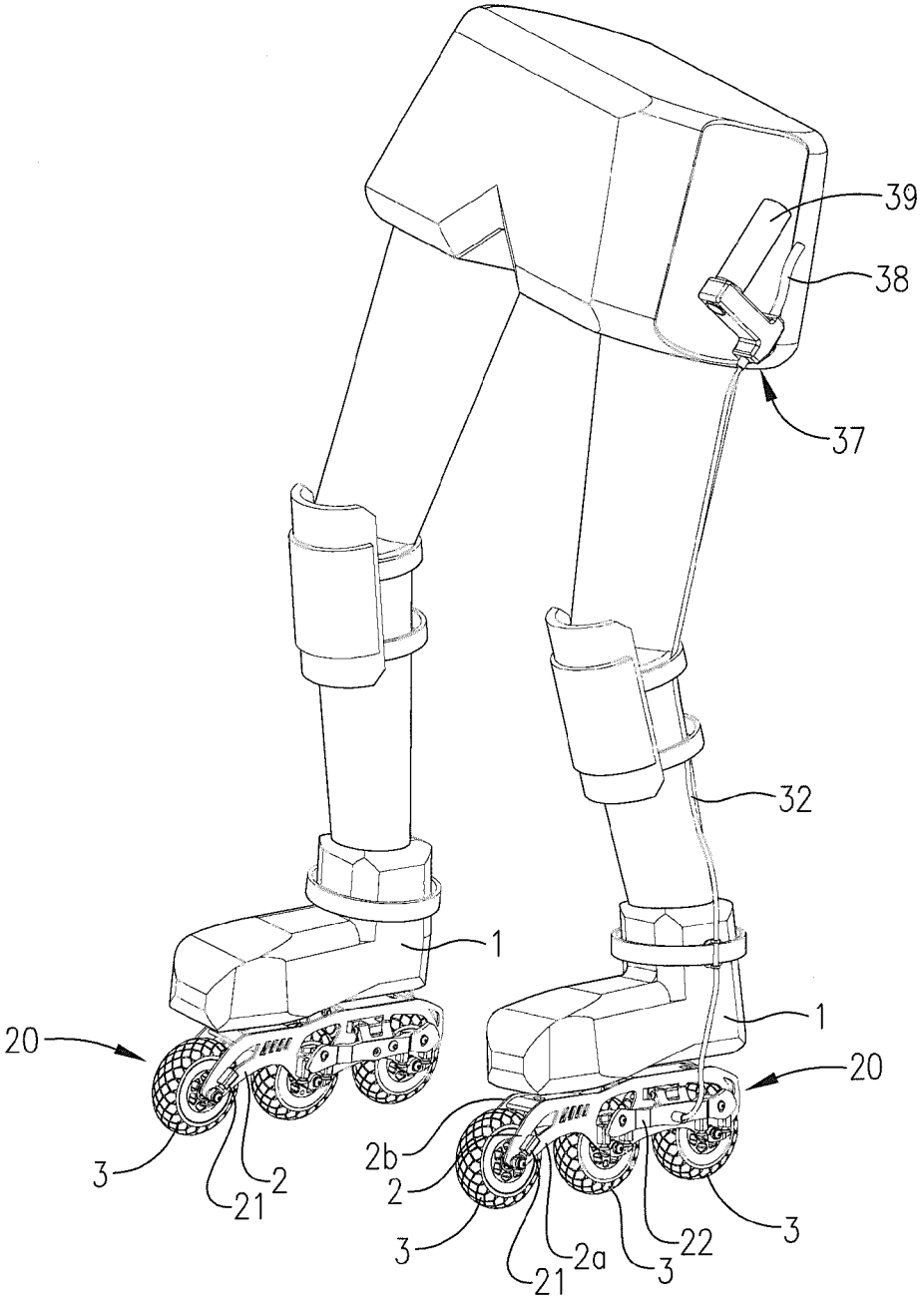
FIG. 6 is a schematic view taken from the left side of a skater showing a manual controller attached to a skater's clothing and connected to the braking system of one of the roller skates by a Bowden cable.

Skate 20, including both skate 20*a* as shown particularly in FIGS. 1-6 and skate 20*b* as shown in FIGS. 7-9, at least at two of the rear wheels 3 are provided with a braking system 22 including a pair of clips 31 positioned in spaced apart generally parallel orientations, one such clip 31 being located outboard of each the left and right carrier frames 2*a* and 2*b* of the carrier 2, each of the clips of said braking system 22 being attached to the carrier 2 by an articulated or pin joint 5 respectively. The braking system 22 may be governed, actuated or operated by an elongated flexible member such as, for example, a Bowden cable 32. As known by those skilled in the art, the Bowden cable 32 includes an outer sheath 32*a* which surrounds an interior cable 32*b* which is shiftable within the sheath. The Bowden cable may be indirectly or directly attached to one of the clips 31. As shown in FIGS. 2-5 with respect to skate 20*a*, the sheath of the Bowden cable 32 may be mounted, such as by insertion into a receiver 33 of one of the clips 31, and the interior cable may extend through a transverse opening through the carrier 2 and within a brake biasing spring 34 to be connected to the opposite one of the clips 31 on the other side of the carrier 2. The brake biasing spring 34, best seen in FIGS. 2-4, maintains the two clips 31 in an expanded or unbraked condition. By applying a tensioning force to the interior cable of the Bowden cable 32, a pad or block 35 (shown in broken lines in FIGS. 1 and 7) mounted on the interior of each of the clips 31 to which the Bowden cable or other flexible member is attached frictionally engages one or more of the wheels 3 and/or the tire 36 mounted thereon. The Bowden cable 32 is most preferably be connected at the end thereof remote from the skate 20 to a manual controller 37. The manual controller 37 includes a lever actuator 38 which may be shifted toward a handle 39 to apply tension to the inner cable and actuate the braking system. As shown in FIG. 6, the manual controller 37 may be adapted to be attached to rider's cloth, i.e. the rider's shirt, pants, belt or other article worn by the rider. At or adjacent each braked wheel 3 the clip 31 of the braking system 22 is provided with a brake pad or block 40 situated adjacent a disk portion 41 of tire 36 or of the wheel 3. The brake pads or blocks 40 may be removably mounted to the clips 31 by threaded screws or bolts. It is to be understood that the braking system 22 for the skate 20*b* having 4 wheels is the same as that illustrated for skate 20*a* having three wheels, except that the clip 31 may longer, extending in covering relation to wheels 3*b*, 3*c* and 3*d*, and may be provided with a brake pad or block 40 on each side of each of the wheels 3*b*, 3*c* and 3*d*.

For skate 20*b* where the clips 31 extend along the exterior of each of the left and right sides of the wheels 3*b*, 3*c* and 3*d*, it may be desirable to have multiple receivers 33 for actuating the clips 31 and brake pads 40. FIGS. 7, 8 and 9 illustrate a yoke assembly 47 which may be used with two such receivers 33. The yoke assembly 47 may include a leg 47*a* mounted to the carrier 2, a flange 47*b* which receives the Bowden cable 32 connected to the manual controller 37 and permits its interior cable to pass therethrough, a finger 47*c* which is fastened to the end of the interior cable 32*b* remote from the manual controller 37, a second Bowden cable 48 which includes a loop 48*a* of an inner cable thereof and two divergent cable sections 48*b* and 48*c*, and a spreader 47*d*. Each of the divergent cable sections 48*b* and 48*c* operates similarly to the Bowden cable 32 as used with roller skate 20*a*, in that when the manual controller 37 is actuated, the interior cable 32*b* pulls upwardly on the finger 47*c*, which in turn applies tension to the loop 48*a* and thus the inner cable of the second Bowden cable, which is connected through the two receivers 33 of one clip and the inner cable to each of the other clips on the opposite side of the carrier 2, and thus causes the clips to move inwardly to press the brake pads 40 against the wheels 3*b*, 3*c* and 3*d*.

Figure 10:
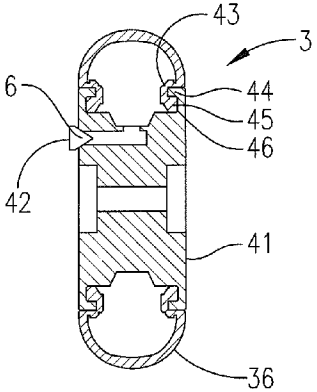
FIG. 10 is an enlarged cross sectional view of a skate wheel for use with the skate hereof with an inflatable tire.

In particularly preferred embodiments, the roller skates 20*a* and 20*b* may be equipped with wheels 3 which include inflatable tubeless tires 36. When pneumatic tubeless tires are utilized, an air duct 6 may be provided in the disk portion 41 of the wheel 3, and a valve insert 42 may be installed therein. The valve insert is shown schematically in FIG. 10, it being understood by those skilled in the art that various types of known valve inserts such as for example Schrader valves, Presta valves or Dunlop valves are suitable for such applications. For example, the air duct 6 may be threaded whereby the valve insert 42 may be screwed into the air duct 6. The tire foot or bead, like the tread, may be made of rubber and/or a rubber-textile combination. Alternatively, the valve insert 42 may be installed in the tire 36 directly, wherein the valve insert may then extend from the tire sidewall. The tire 36 may be provided with a groove 43 in which a disk lug 44 fits and with a lug 45 which fits into a disk groove 46. The tire 36 may also be provided with a casing having a sidewall which may be equipped with a metal ring-shaped surface for contacting the brake block or pad. This metal contacting surface protects the tire from damage owing to friction generated in braking. The wall thickness of the casing may be, for example, about 3 mm.

These exemplary embodiments are shown in FIGS. 1-11.

Example No. 2

An assembling stand 50 particularly useful in assembling, maintaining or repairing the skate 20 may broadly include a vertically oriented main girder 11 which may be provided in its bottom part with a screw clamp 15 which serves to fix the stand 50 to, for example, a working desk or workbench (not shown). In its top part the main girder 11 may be equipped with a shifting and rotating girder coupling 13. The shifting and rotating girder coupling 13 may include a first locking screw 13*a*, a first sleeve 13*b* which is preferably configured to slide along and rotate about the main girder 11 and to which the first locking screw 13*a* is threadably mounted for engagement with the main girder 11, and a preferably cylindrical side stub 13*c*. An auxiliary girder 12 may be fastened on the girder coupling 13, the auxiliary girder 12 having a first end 12*a* which is preferably tubular and complementally configured with side stub 13*c* and to which a second locking screw 12*b* is threadably mounted, and a second end 12*c* which may be equipped with a longitudinally adjustable pull-out arm 14.

Figure 12:
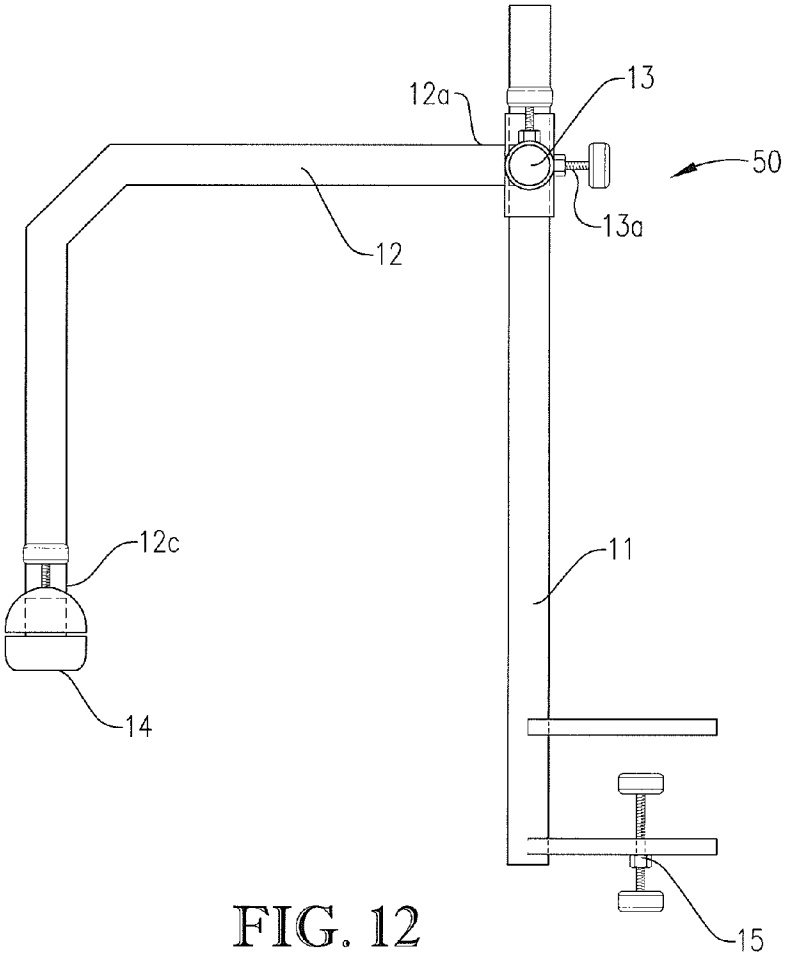
FIG. 12 is a side elevational view of an assembling stand useful for assembling or working on a skate as shown in FIGS. 1 through 6.
Figure 13:
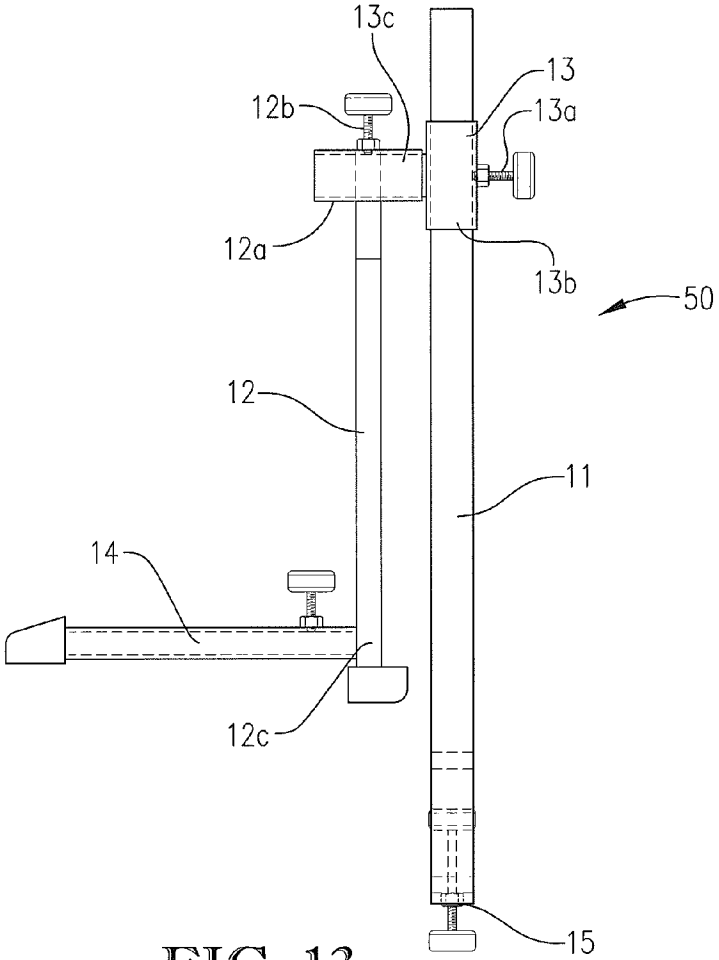
FIG. 13 is a front elevational view of the assembling stand hereof.

An exemplary embodiment of the assembling stand 50 is shown in FIGS. 12 and 13.

In use, the worker may use the screw clamp to attach the assembling stand to a support, such as, for example, a working desk or workbench. The worker may then loosen threaded locking screw 13*a* and adjust the position of the auxiliary girder 12 to a useful location. A roller skate, such as skate 20*a* or 20*b*, may then be mounted, in the same way as a person puts a roller skate on his foot, onto the adjustable arm 14, the adjustable arm 14 being set to a length corresponding with a size of shoe 1, to facilitate assembly of the skate or maintenance such as cleaning or repair.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. A roller skate comprising:

a shoe;

a carrier joined to the shoe;

four wheels including a front wheel and three rearward wheels, the three rearward wheels being arranged in an in-line orientation on the carrier;

an axle extending through each wheel;

a first suspension system including two compressible coiled springs having longitudinal axes oriented at an angle comprising both horizontal and vertical components, the bottom ends of the two springs being located in front of and/or under the top ends of the two springs;

second, third, and fourth suspension systems each including:

four compressible coiled springs having longitudinal axes oriented vertically; and left and right hubs connected to one of the axles, wherein a first pair of the four compressible coiled springs are joined to the left hub and a second pair of the four compressible coiled springs are joined to the right hub such that one spring of each pair of springs is connected in front of the axle and the other spring of each pair of springs is connected behind the axle;

wherein each one of the four wheels is independently cushioned by one of the four suspension systems.

2. A roller skate according to claim 1, wherein the force of each spring is between 7 and 15 kg at maximum depression.

3. A roller skate according to claim 1, wherein at least two of the wheels each are equipped with a jaw brake extending to both sides of the wheel and including a jaw having a brake block positioned adjacent the wheel, the brake being coupled by an articulated or pin joint respectively to the carrier and being actuatable by an elongated flexible member operatively connected to a manual controller.

4. A roller skate according to claim 1, wherein the wheels each include a disk and an inflatable tubeless tire, wherein the disks each include an air duct mount and a valve insert connected thereto.

5. A roller skate according to claim 4, wherein the inflatable tubeless tires each are formed of a composition selected from the group consisting of rubber, rubber-textile, and combinations thereof, and wherein each tire includes a groove and each disk includes a disk lug fitting in the groove so as to create an interlocking joint.

6. A roller skate according to claim 3, wherein the tire sidewall includes a metal surface and the brake block is positioned adjacent metal surface of the tire sidewall.

* * * * *